US008254820B2

(12) United States Patent
Hanano

(10) Patent No.: US 8,254,820 B2
(45) Date of Patent: Aug. 28, 2012

(54) CLEANING DEVICE THAT CLEANS A SURFACE OF AN IMAGE BEARING MEMBER BY REMOVING SUBSTANCES REMAINING ON THE SURFACE OF THE IMAGE BEARING MEMBER AFTER A TONER IMAGE IS TRANSFERRED ONTO A SHEET AND IMAGE FORMING APPARATUS INCLUDING THE SAME

(75) Inventor: Susumu Hanano, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 417 days.

(21) Appl. No.: 12/576,357

(22) Filed: Oct. 9, 2009

(65) Prior Publication Data

US 2010/0189480 A1 Jul. 29, 2010

(30) Foreign Application Priority Data

Jan. 26, 2009 (JP) ..... 2009-013860

(51) Int. Cl.
*G03G 21/00* (2006.01)

(52) U.S. Cl. ..... 399/349; 399/357; 399/358

(58) Field of Classification Search ..... 399/349, 399/353, 357, 358; 15/256.5, 256.51, 256.52
See application file for complete search history.

(56) References Cited

U.S. PATENT DOCUMENTS

| | | | | |
|---|---|---|---|---|
| 3,644,959 | A * | 2/1972 | Ohta | 15/256.52 |
| 4,172,303 | A * | 10/1979 | Wooding et al. | 399/349 |
| 4,963,944 | A * | 10/1990 | Tange | 399/357 |
| 6,795,682 | B2 * | 9/2004 | Nakahara | 399/353 |
| 7,702,275 | B2 * | 4/2010 | Morishita | 399/357 |

FOREIGN PATENT DOCUMENTS

| | | |
|---|---|---|
| JP | 10-063157 | 3/1998 |
| JP | 2000-276026 | 10/2000 |

* cited by examiner

*Primary Examiner* — William J Royer
(74) *Attorney, Agent, or Firm* — Frommer Lawrence & Haug LLP

(57) ABSTRACT

A cleaning device may include a polishing roller, an ejection member, and a conveying member. In some embodiments, the polishing roller may be configured to remove and collect a residual substance adhering to a surface of an image bearing member while rotating in contact with the image bearing member. In an embodiment, the ejection member may be configured to eject the substance collected by the polishing roller to the outside of the cleaning device. An embodiment may include a conveying member configured to follow the rotation of the polishing roller by being in contact with the polishing roller and to convey toner in the cleaning device on a surface of the polishing roller in an axial direction of the polishing roller. When an image is not formed, the polishing roller rotates in a direction opposite a rotating direction in which the polishing roller rotates when an image is formed.

10 Claims, 4 Drawing Sheets

CLEANING DEVICE THAT CLEANS A SURFACE OF AN IMAGE BEARING MEMBER BY REMOVING SUBSTANCES REMAINING ON THE SURFACE OF THE IMAGE BEARING MEMBER AFTER A TONER IMAGE IS TRANSFERRED ONTO A SHEET AND IMAGE FORMING APPARATUS INCLUDING THE SAME

INCORPORATION BY REFERENCE

This application is based upon and claims the benefit of priority from the corresponding Japanese Patent application No. 2009-13860, filed Jan. 26, 2009, the entire content of which is incorporated herein by reference.

FIELD OF THE INVENTION

The present invention relates to a cleaning device that cleans a surface of an image bearing member by removing substances, such as toner, remaining on the surface of the image bearing member after a toner image is transferred onto a sheet. The present invention also relates to an image forming apparatus including the cleaning device, for example, a copying machine or a printer.

BACKGROUND OF THE INVENTION

In electrophotographic image forming apparatuses, such as copying machines and printers, a photosensitive drum is widely used as an image bearing member. An image forming operation using a photosensitive drum is generally performed as follows. A surface of the photosensitive drum is uniformly charged to a predetermined potential by a charging device. When the surface of the photosensitive drum is irradiated with LED light from an exposure device, the potential thereon partially attenuates to form an electrostatic latent image of a document image on the surface of the photosensitive drum. By developing the electrostatic latent image with a developing device, a toner image is formed on the surface of the photosensitive drum. The toner image is transferred onto a sheet when the sheet passes through a transfer region where the photosensitive drum and a transfer member are in contact with or adjacent to each other. Instead of being directly transferred from the photosensitive drum, the toner image may be transferred onto the sheet via an intermediate transfer member.

In such an image forming apparatus, after the toner image is transferred onto the sheet or the intermediate transfer member, a small amount of toner may not be transferred. Thus, an amount of toner may remain on the surface of the photosensitive drum. The residual toner adhering to the surface of the photosensitive drum interferes with the next image forming operation, and therefore needs to be cleaned off. Currently practiced cleaning methods for cleaning the photosensitive drum include: moving the residual toner onto a surface of a rotating member, such as a roller or a rotating brush, by pressing the rotating member against the surface of the photosensitive drum, or scraping off the residual toner by using a blade in contact with the surface of the photosensitive drum to scrape a surface of the photosensitive drum, or removing the residual toner by a combination of the above methods.

It is known that, when the photosensitive drum is formed of amorphous silicon, corona products easily adhere onto the surface of the photosensitive drum because of charge elimination by a charging device. If the corona products absorb water, the electric resistance of the surface of the photosensitive drum decreases, and this may distort an electrostatic latent image. In a known cleaning method for preventing this trouble, toner, in which a small amount of abrasive is mixed and which remains and adheres to a surface of a photosensitive member, is removed and collected by both a roller and a cleaning blade, and corona products adhering to the surface of the photosensitive member are cleaned off by polishing with a small amount of toner held on a surface of the roller. Polishing of the surface of the photosensitive member is also effective in preventing toner filming which impairs optical sensitivity and charging performance and in which toner components thinly adhere over a wide range on the surface of the photosensitive member.

There has been proposed a cleaning device that removes corona products adhering to a surface of a photosensitive drum with the polishing roller and the cleaning blade described above. This cleaning device includes a polishing roller (slide roller) for polishing the surface of the photosensitive drum by being in contact therewith, and a cleaning blade provided downstream of the polishing roller in the rotating direction of the photosensitive drum. The polishing roller cleans the surface of the photosensitive drum by polishing with toner directly removed from the surface of the photosensitive drum or toner removed and moved by the cleaning blade.

In this cleaning device, however, toner does not always uniformly adhere on the surface of the polishing roller in the axial direction. If the amount of toner adhering to the surface of the polishing roller is not uniform in the axial direction, the surface of the photosensitive drum is unevenly polished, and this causes cleaning failure. Accordingly, to solve this problem, a cleaning device devised to uniformly distribute (e.g., uniformized) the amount of toner in the axial direction of the surface of the polishing roller has been proposed.

In such a cleaning device, a scraper extends in contact with a lower portion of the polishing roller in the axial direction (width direction) so that residual toner removed and collected from the surface of the photosensitive drum stays at a contact portion between the polishing roller and the scraper. While this method may be able to avoid a phenomenon in which the amount of toner becomes extremely small at a portion in the axial direction of the surface of the polishing roller, it cannot be said that the method is suited for uniformly distributing (i.e., uniformizing) the amount of toner as a whole. The amount of toner staying at the contact portion between the polishing roller and the scraper depends on the operation of cleaning the surface of the photosensitive drum with the polishing roller or the cleaning blade. Thus, the toner may not be uniformly distributed (i.e., positively uniformized) in the axial direction of the polishing roller.

Hence, even in this cleaning device, toner may non-uniformly adhere to the surface of the polishing roller in the axial direction, and this may make it difficult to sufficiently polish the entire surface of the photosensitive drum.

SUMMARY OF THE INVENTION

An object of the present invention is to uniformly distribute or uniformized the amount of adhering toner in the axial direction of a polishing roller.

In an embodiment, a cleaning device may include a polishing roller, an ejection member, and a conveying member. The polishing roller may be configured to remove and collect a residual substance adhering to a surface of an image bearing member. The polishing roller may rotate in contact with the image bearing member to remove one or more residual substances from the surface of the image bearing member. The ejection member may be configured to eject the substance collected by the polishing roller to the outside of the cleaning device. The conveying member may be configured to rotate in a manner which follows the rotation of the polishing roller by being in contact with the polishing roller. When an image is not formed, the polishing roller rotates in a direction opposite a rotating direction in which the polishing roller rotates when an image is formed. Thus, the toner may be conveyed along a surface of the polishing roller in an axial direction.

The above and other objects, features, and advantages of the present invention will be more apparent from the following detailed description of embodiments taken in conjunction with the accompanying drawings.

In this text, the terms "comprising", "comprise", "comprises" and other forms of "comprise" can have the meaning ascribed to these terms in U.S. Patent Law and can mean "including", "include", "includes" and other forms of "include".

Various features of novelty which characterize the invention are pointed out in particularity in the claims annexed to and forming a part of this disclosure. For a better understanding of the invention, its operating advantages and specific objects attained by its uses, reference is made to the accompanying descriptive matter in which exemplary embodiments of the invention are illustrated in the accompanying drawings in which corresponding components are identified by the same reference numerals.

BRIEF DESCRIPTION OF THE DRAWINGS

The following detailed description, given by way of example, but not intended to limit the invention solely to the specific embodiments described, may best be understood in conjunction with the accompanying drawings, in which.

DETAILED DESCRIPTION OF THE PREFERRED EMBODIMENTS

Reference will now be made in detail to various embodiments of the invention, one or more examples of which are illustrated in the accompanying drawings. Each example is provided by way of explanation of the invention, and by no way limiting the present invention. In fact, it will be apparent to those skilled in the art that various modifications, combinations, additions, deletions and variations can be made in the present invention without departing from the scope or spirit of the present invention. For instance, features illustrated or described as part of one embodiment can be used in another embodiment to yield a still further embodiment. It is intended that the present invention covers such modifications, combinations, additions, deletions, applications and variations that come within the scope of the appended claims and their equivalents.

Embodiments of the present invention will be described below with reference to FIGS. 1 to 4.

In some embodiments, a cleaning device described herein may be utilized in an image forming apparatus. In some embodiments, an image forming apparatus utilizing the cleaning device may include, but is not limited to, an image forming apparatus for color printing that transfers a toner image onto a sheet via an intermediate transfer belt, an image forming apparatus that does not use an intermediate transfer belt, an image forming apparatus for monochrome printing, and other image forming apparatuses known in the art.

Figure 1:
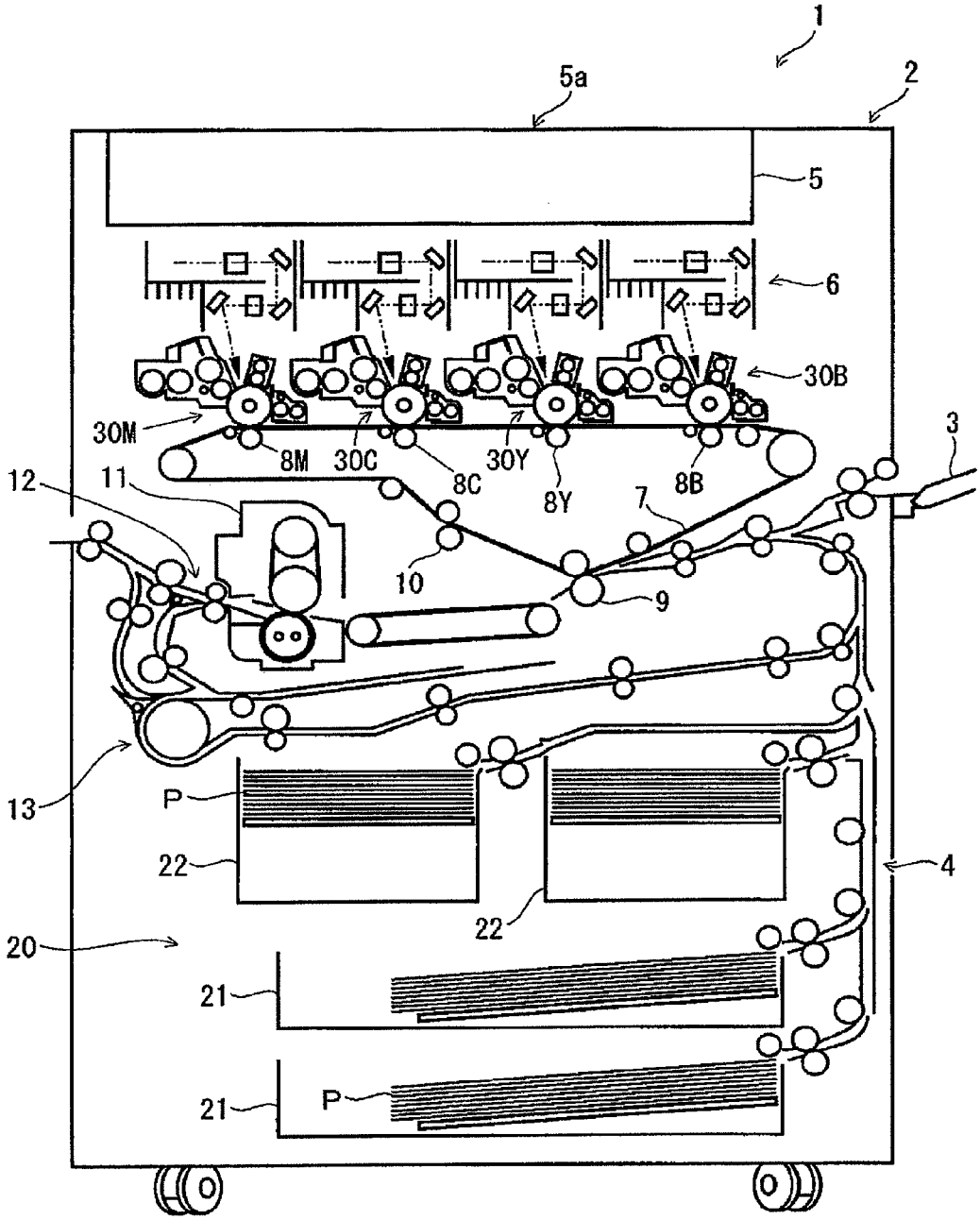
FIG. 1 is a schematic vertical sectional front view of an image forming apparatus including a cleaning device according to an embodiment.

FIG. 1 is a schematic vertical sectional front view of an image forming apparatus 1 including a cleaning device 70. As shown in FIG. 1, image forming apparatus 1 may be a color printing type that transfers a toner image onto a sheet P via an intermediate transfer belt 7.

Referring to FIG. 1, sheet feed cassette unit 20 is provided in an inner lower part of main body 2 of image forming apparatus 1. Sheet feed cassette unit 20 includes two general-purpose sheet cassettes 21 and two large-capacity sheet cassettes 22. In some embodiments, the numbers, types, capacities, and/or positions of the sheet cassettes may vary. For example, an embodiment may include one general-purpose sheet cassette and three large-capacity cassettes. As shown in FIG. 1, an embodiment of the image forming apparatus 1 may include general-purpose sheet cassettes 21 having the same capacity and arranged in the vertical direction. Further, large-capacity sheet cassettes 22 may have the same capacity and the same height, and be arranged in the horizontal direction in some embodiments. Each sheet cassette may store a stack of sheets P. For example, a sheet cassette may store cut sheets of paper that have not been subjected to printing. The sheets P may be separated and fed out one by one toward the right side of the sheet cassette in FIG. 1. In some embodiments, the sheet cassettes can be horizontally drawn out from the front side of main body 2.

In some embodiments, manual feed unit 3 is provided outside an upper portion of a right side of main body 2. In manual feed unit 3, sheets having sizes different from the sizes of the sheets stored in sheet feed cassette unit 20, or sheets P to be manually supplied one by one, such as thick paper and OHP sheets, are stacked.

Vertical conveying unit 4 is provided inside a lower part of main body 2 near the right side surface. Vertical conveying unit 4 is located on the right side of sheet feed cassette unit 20 in the feeding direction and on the left side of manual feed unit 3 in the feeding direction. A sheet P fed out from sheet feed cassette unit 20 is vertically conveyed upward along the right side of main body 2 by vertical conveying unit 4. A sheet fed out from manual feed unit 3 is conveyed to the left in the substantially horizontal direction. A sheet P fed out from large-capacity sheet cassette 22 positioned on the left is conveyed in the substantially horizontal direction immediately above large-capacity sheet cassette 22 positioned on the right. Sheet P is then vertically conveyed upward along the right side of main body 2.

In some embodiments, the components shown in FIG. 1 may be positioned in alternate arrangements. For example, the conveyance of the paper may be changed and/or the position of the sheet cassettes may be altered.

A document feeding device (not shown) may be provided on an upper surface of main body 2 of image forming apparatus 1. As shown in FIG. 1, some embodiments include image-reading device 5 provided below the document feeding device. To copy a document having images of characters, figures, patterns, and the like, the user places the document on the document feeding device or on platen glass 5*a* on an upper surface of image reading device 5, and then starts printing. The document feeding device separates and feeds out documents one by one. While a fed document passes over the platen glass 5*a*, image data on the document is read by image reading device 5. Information about the image data is sent to scanning optical device 6 serving as an exposure means provided immediately below image reading device 5. Scanning optical device 6 emits laser light (shown by a two-dot chain line), which is controlled according to the image data, toward image forming units 30 (30M, 30C, 30Y, and 30B).

Immediately below scanning optical device 6, four image forming units 30 (30M, 30C, 30Y, and 30B) are provided, and intermediate transfer belt 7 shaped like an endless belt serving as an intermediate transfer member is provided below image forming units 30. Intermediate transfer belt 7 is supported by being wound around a plurality of rollers, and is rotated in the clockwise direction in FIG. 1 by a driving device (not shown).

As shown in FIG. 1, some embodiments include four image forming units 30 (30M, 30C, 30Y, and 30B) arranged in a so-called tandem manner, that is, arranged in line from the upstream side to the downstream side in the rotating direction of intermediate transfer belt 7. A magenta image forming unit 30M, a cyan image forming unit 30C, a yellow image forming unit 30Y, and a black image forming unit 3013 are arranged in order from the upstream side. Embodiments may include any number of image forming units 30. In an embodiment, colors of the image forming units 30 may vary to include any color combination. Developing agent (toner) may be supplied to the image forming units 30 by developing-agent supply containers and conveying means (not shown) corresponding to the colors. In the following description, identification symbols M, C, Y, and B indicating the colors, magenta, cyan, yellow and black, respectively, are omitted unless otherwise specified.

In each image forming unit 30, an electrostatic latent image of a document image may be formed by laser light emitted from scanning optical device 6, which serves as the exposure means. The document image is then developed into a toner image. The toner image is primarily transferred onto a surface of intermediate transfer belt 7 at primary transfer roller 8 provided below the corresponding image forming unit 30. With rotation of intermediate transfer belt 7, the toner image is transferred from each image forming unit 30 onto intermediate transfer belt 7 at a predetermined timing, so that toner images of four colors, magenta, cyan, yellow, and black are superimposed into a color toner image on the surface of intermediate transfer belt 7.

As shown in FIG. 1, secondary transfer roller 9 may be provided at a position where intermediate transfer belt 7 meets the sheet conveying path. The color toner image on the surface of intermediate transfer belt 7 is transferred onto a sheet P, which is conveyed in synchronization by vertical conveying unit 4, at a secondary transfer nip formed by pressing contact between intermediate transfer belt 7 and secondary transfer roller 9.

After secondary transfer, substances, such as toner, remaining on the surface of intermediate transfer belt 7 are removed and collected by cleaning device 10. Cleaning device 10 is provided downstream of secondary transfer roller 9 in the rotating direction of intermediate transfer belt 7 so as to clean intermediate transfer belt 7.

Fixing device 11 is provided downstream of secondary transfer roller 9 in the sheet conveying direction. After an unfixed toner image is transferred onto sheet P at the secondary transfer nip, sheet P is conveyed to fixing device 11, where the toner image is fixed by heat and pressure with a heating roller and a pressing roller.

Branch portion 12 is provided on the downstream side of fixing device 11 and near a left side of main body 2. When duplex printing is not performed, sheet P passing through fixing device 11 is conveyed to the left from the branch portion 12, and is ejected into a sheet output tray (not shown) provided outside the left side of the image forming apparatus 1. In some embodiments, components of the printing device may be placed in a different configuration. For example, components as listed here may be reversed such that the sheet is ejected into a sheet output tray on the right side of the image forming apparatus 1.

As shown in FIG. 1, duplex printing device 13 is provided below a portion between secondary transfer roller 9 and branch portion 12 and above sheet feed cassette unit 20. For duplex printing, sheet P with a printed first surface passes through fixing device 11, and is conveyed to duplex printing device 13 via branch portion 12. For the next printing on a second surface, the sheet P conveyed to duplex printing device 13 is turned upside down by switching the conveying direction. Then, the sheet P is conveyed to the right side of main body 2, and is conveyed again to secondary transfer roller 9 via vertical conveying unit 4.

Figure 2:
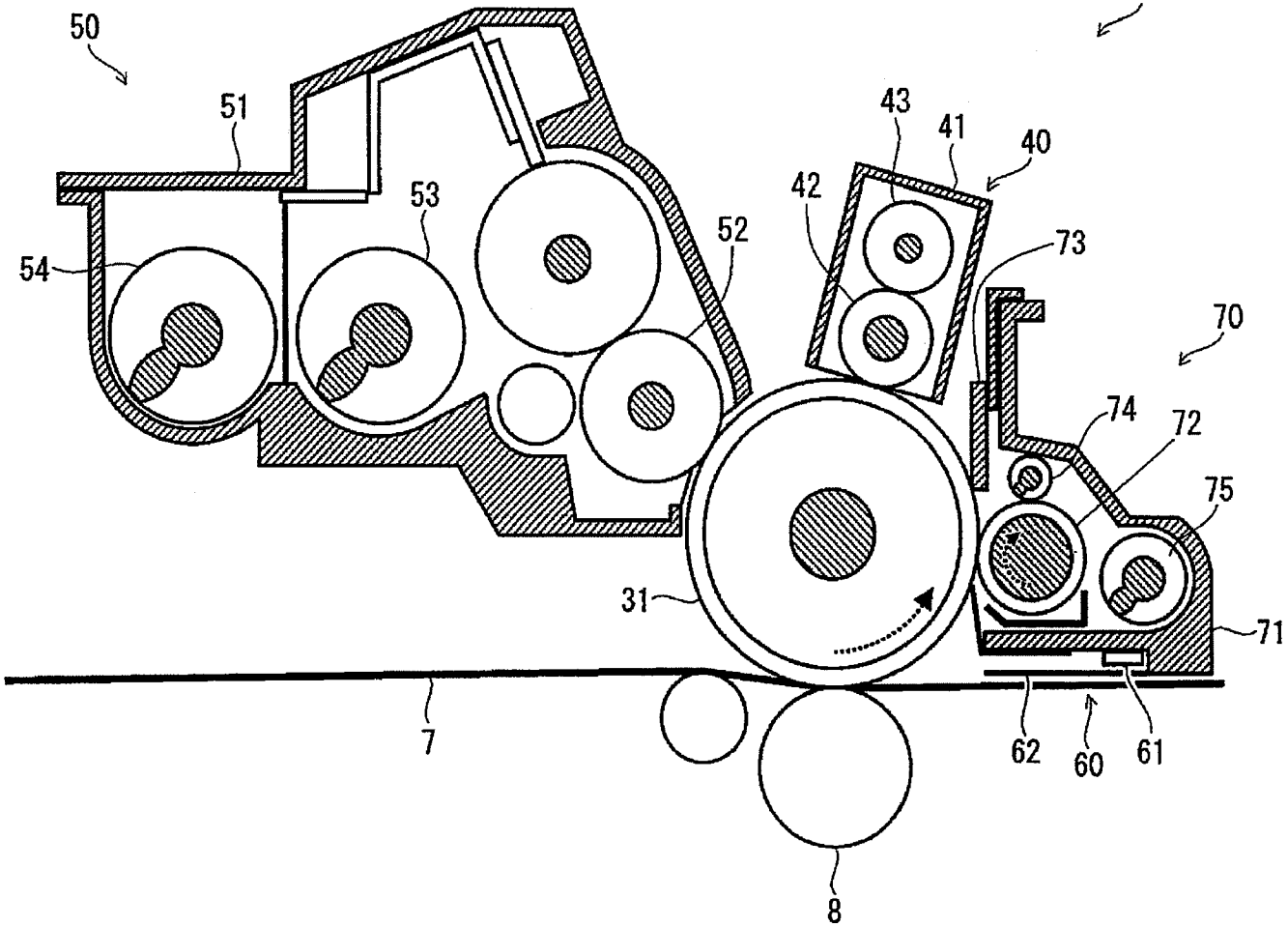
FIG. 2 is a vertical sectional front view showing an image forming unit and its surroundings in the image forming apparatus of the embodiment shown in FIG. 1.

Next, a detailed structure near the image forming unit 30 in the image forming apparatus 1 will be described with reference to FIG. 2 as well as FIG. 1. FIG. 2 depicts a vertical sectional front view showing the image forming unit 30 and its surroundings. Since the structure is common to the four image forming units 30, the identification symbols M, C, Y, and B referring to the colors magenta, cyan, yellow and black, respectively, are omitted, as described above.

Referring to FIG. 2, image bearing member 31 serving as an image bearing member is provided in the center of image forming unit 30. Devices, such as charging device 40, developing device 50, charge eliminating device 60, and cleaning device 70 may be positioned proximate image bearing member 31. In some embodiments, devices 40, 50, 60, 70 may be arranged such that the order of the devices 40, 50, 60, 70 engaging a specific point on the image bearing member 31 corresponds to the direction of rotation of image bearing member 31. For example, as is shown in FIG. 2, where image bearing member 31 rotates in a counter-clockwise direction, charging device 40, developing device 50, charge eliminating device 60, and cleaning device 70 are arranged in order, in a counter-clockwise orientation corresponding to the rotational direction of the image bearing member 31. As shown in FIG. 2, primary transfer roller 8 is provided between developing device 50 and charge eliminating device 60 in the rotating direction of the image bearing member 31.

As shown in FIG. 2, image bearing member 31 extends in the direction corresponding to the width of a sheet, which is also perpendicular to the sheet conveying direction in the image forming apparatus 1. In some embodiments, such as in FIGS. 1 and 2, the linear direction along which image bearing member 31 extends across a sheet or intermediate transfer belt 7 in contact therewith at a given point in time may be referred to as the axial direction of the image bearing member 31. In some embodiments, such an axial direction may be parallel to an axis of rotation about which image bearing member 31 is configured to rotate.

In some embodiments, image bearing member 31 may be a photosensitive drum. In some embodiments, the diameter of the image bearing member (e.g., photosensitive drum) may be in a range from about 20 mm to about 60 mm. For example, an image bearing member may be an inorganic photosensitive drum having a diameter of 30 mm. In an embodiment, the image bearing member may include a base, shaped like a conductive roller of aluminum or the like. Some embodiments of an image bearing member may include inorganic photoconductive material proximate an outer surface. For example, an embodiment of an image bearing member may include a photosensitive layer of amorphous silicon serving as an inorganic photoconductive material provided on an outer side of the base. In some embodiments, the photosensitive layer may be provided to the image bearing member by vacuum deposition or by other methods. In some embodiments, image bearing member 31 is rotated by a driving device (not shown). The image bearing member 31 may be rotated at a peripheral speed in a range from about 150 mm/s to about 460 mm/s. For example, the image bearing member 31 may be rotated at a peripheral speed equal to a sheet conveying speed (e.g., 160 mm/s).

As depicted in FIG. 2, charging device 40 includes housing 41, and charging roller 42 provided in the housing 41. Charging roller 42 may be positioned in a manner such as to be in contact with image bearing member 31. In some embodiments, charging roller 42 may be in pressing contact with the image bearing member 31 with a predetermined pressure. Further, the charging roller 42 may rotate to follow rotation of the image bearing member 31. In some embodiments, charging roller 42 uniformly charges the surface of image bearing member 31 to a predetermined polarity and a predetermined potential. As shown in FIG. 2, in housing 41, brush roller 43 may also be provided on a side of charging roller 42 opposite the image bearing member 31. Brush roller 43 may clean a surface of charging roller 42 by being in contact therewith.

As depicted in FIG. 2, developing device 50 includes housing 51, developing roller 52, conveying screw 53, and agitating screw 54. In some embodiments, the developing roller 52, the conveying screw 53 and the agitating screw 54 may be provided in housing 51. Developing roller 52 may utilize a contact or noncontact developing method. Developing roller 52 may be provided near image bearing member 31. In some embodiments, a bias having the same polarity as the charging polarity of the image bearing member 31 may be applied to developing roller 52. Developing roller 52 charges toner serving as the developing agent, and moves the toner to the electrostatic latent image on the surface of image bearing member 31, so that the electrostatic latent image is developed.

In some embodiments, developing device 50 may be used with a two-component developing agent in which magnetic carrier and nonmagnetic toner are mixed. In various embodiments, the developing device 50 may use a monocomponent magnetic toner. Some embodiments of the developing device 50 may utilize a nonmagnetic toner. In an embodiment, a surface of the image bearing member 31 may be cleaned by polishing, utilizing a small number of fine particles. Fine particles utilized may include, but are not limited to titanium oxide, aluminum, or other fine particles known in the art. Fine particles may be mixed as a toner additive in the developing agent. The developing agent may be stored in a developing-agent supply container (not shown). In some embodiments, the developing agent is supplied into housing 51 from above (e.g., above agitating screw 54 region) by a conveying means (not shown). The supplied toner may be conveyed to developing roller 52 while being agitated by agitating screw 54 and conveying screw 53 in developing device 50.

An embodiment may include primary transfer roller 8 provided downstream of developing device 50 in the rotating direction of image bearing member 31. Primary transfer roller 8 may face image bearing member 31 with intermediate transfer belt 7 being disposed therebetween. In some embodiments, primary transfer roller 8 may be in pressing contact with image bearing member 31 to form a primary transfer nip through which sheet P passes. An embodiment may include primary transfer roller 8, which is not rotated by a driving device, but is rotated by being in contact with intermediate transfer belt 7. Thus, the primary transfer roller 8 may, in some embodiments, follow the rotation of intermediate transfer belt 7. Further, a transfer bias having a polarity different from the charging polarity of image bearing member 31 and toner may be applied to primary transfer roller 8, as required.

As shown in FIG. 1, in some embodiments intermediate transfer belt 7 may be supported by being wound around a plurality of rollers. Intermediate transfer belt 7 may be formed by an elastic belt in which a surface of a base layer formed of synthetic resin is coated with a rubber layer. For example, in some embodiments, the base layer may be formed of polyvinylidene fluoride (PVDF) and chloroprene rubber (CR), and the coating rubber layer may be formed of silicone and urethane, polytetrafluoroethylene (PTFE) and urethane, or a combination thereof.

Charge eliminating device 60 may be provided downstream of primary transfer roller 8 in the rotating direction of image bearing member 31. In some embodiments, a charge eliminating device may include a light source and a reflector. Light sources utilized may include but are not limited to a light emitting diode, an electroluminescence (EL) light source or a fluorescent lamp. A reflector utilized in an embodiment of a charge eliminating device may be a reflecting plate. For example, as shown in FIG. 2, charge eliminating device 60 may include light emitting diode (LED) 61 and reflecting plate 62. LED 61 may be attached to a lower surface of housing 71 of cleaning device 70. In some embodiments, reflecting plate 62 may be provided below LED 61 in a manner such as to cover LED 61. Charge eliminating device 60 removes charges on the surface of image bearing member 31 by emitting charge eliminating light from LED 61 onto image bearing member 31, thereby making preparation for a charging step in the next image forming operation.

In some embodiments, cleaning device 70 for the image bearing member 31 may be provided downstream of primary transfer roller 8. In an embodiment, cleaning device 70 may be positioned further downstream of charge eliminating device 60 in the rotating direction of image bearing member 31. As shown in FIG. 2, cleaning device 70 includes housing 71, polishing roller 72, cleaning blade 73, conveying screw 74 serving as a rotating conveying member, and ejection screw 75 provided in housing 71.

As depicted in FIG. 2, some embodiments may include polishing roller 72 provided in a lower part of housing 71. Some polishing roller 72 embodiments may have diameters in a range from about 12 mm to about 16 mm. An embodiment may include a polishing roller 72, which is urged against image bearing member 31 with a predetermined pressure by pressure means (not shown) provided at either end of a shaft thereof. In an embodiment, polishing roller 72 extends in the axial direction of the image bearing member 31. In some embodiments, such an axial direction may be parallel to an axis of rotation about which polishing roller 72 is configured to rotate. Further, in some embodiments, the polishing roller 72 has almost the same axial length as that of the image bearing member 31.

In some embodiments, polishing roller 72 may be rotated by a driving device (not shown) including, for example, a motor. In some embodiments, to efficiently polish the surface of image bearing member 31, polishing roller 72 may be rotated at a predetermined peripheral speed. In some embodiments, the predetermined peripheral speed of the polishing roller 72 may differ from the peripheral speed of image bearing member 31. For example, during image formation, the polishing roller 72 may be rotated at a peripheral speed of about 1.2 times the peripheral speed of the image bearing member 31. The polishing roller 72 may rotate in a direction such that a surface of the polishing roller 72 moves in the same direction as that of the surface of the image bearing member 31 at a contact portion with the image bearing member 31. In some embodiments, the driving device for the polishing roller 72 may include a motor separate from the motor for the driving device of the image bearing member 31. In some embodiments, the driving device for the polishing roller 72 may utilize the motor of the driving device for the image bearing member 31. For example, the polishing roller 72 may utilize the motor for the image bearing member 31 in conjunction with a speed change mechanism, which may include a clutch and the like. In some embodiments, the polishing roller 72 may rotate in a direction different from the rotating direction of the image bearing member 31 or in the same direction, independently of the rotation of the image bearing member 31. Some embodiments may include controlling a speed of the polishing roller 72, such that the rotation rate is in a range from about 200 mm/s to about 550 mm/s.

In some embodiments, the polishing roller 72 may serve to remove and collect substances, such as residual toner, adhering to the surface of the image bearing member 31 while rotating in contact with the image bearing member 31. An embodiment of the polishing roller 72 may polish and clean the surface of the image bearing member 31 with toner containing abrasive and adhering to the surface of the polishing roller 72.

In some embodiments, at least one cleaning blade 73 may be provided downstream of the polishing roller 72 in the rotating direction of the image bearing member 31. For example, as shown in FIG. 2, cleaning blade 73 is provided downstream of polishing roller 72 in the rotating direction of image bearing member 31 and above polishing roller 72 in the vertical direction in housing 71. In some embodiments, the cleaning blade 73 may be positioned proximate the image bearing member 31. An embodiment may include applying pressure to a portion of the cleaning blade 73 to push the cleaning blade 73 against the image bearing member 31 using a pressure means. As shown in FIG. 2, a predetermined pressure may be applied to cleaning blade 73 by pressure means (not shown). In some embodiments, cleaning blade 73 may extend in the axial direction of image bearing member 31. An embodiment of the cleaning blade 73 may have almost the same axial length as that of the image bearing member 31. Cleaning blade 73 embodiments may be used to clean the surface of the image bearing member 31 by being in contact therewith and by scraping off substances, such as residual toner, adhering to the surface of the image bearing member 31.

In some embodiments, a conveying member 74 may be used to convey toner in the housing 71. Some embodiments of a conveying member 74 may have a diameter in a range from about 5 mm to about 16 mm. For example, a conveying member 74 may have a diameter in a range from about 8 mm to about 12 mm. An embodiment of the conveying member 74 may be configured to rotate. In some embodiments, conveying members 74 may be configured to rotate at a speed in a range from about 200 mm/s to about 550 mm/s. Conveying members 74 may include, but are not limited to screws, spirals, elongated members having ridges, agitating members, such as agitators or paddles, any member having a geometry capable of conveying material along the polishing roller 72 and/or combinations thereof. Further, a conveying member 74 may be divided into portions having various geometric configurations capable of conveying material along the polishing roller 72. In an embodiment, a conveying portion may include, but is not limited to a screw conveyor, a spiral conveyor, or any other type of conveyor capable of conveying material in the axial direction of the polishing roller 72. For example, a conveying screw 74 may be used to convey the toner in the housing 71 in a direction corresponding to the axial direction of the polishing roller 72 on the surface of the polishing roller 72.

As shown in FIG. 2, conveying screw 74 serving as the rotating conveying member may be provided above polishing roller 72 and between polishing roller 72 and housing 71. In some embodiments, a surface of the conveying member 74 may be in contact with the surface of the polishing roller 72. In embodiments where the surface of the conveying member 74 is in contact with the polishing roller 72, the conveying member 74 may rotate to follow the rotation of the polishing roller 72. For example, as shown in FIG. 2, a surface of conveying screw 74 may be in contact with a surface of polishing roller 72. Thus, conveying screw 74 rotates in a direction corresponding to the rotation of polishing roller 72. Conveying screw 74 serves to convey toner in the housing 71 in the axial direction of the polishing roller 72 on the surface of the polishing roller 72. A detailed structure of the conveying screw 74 according to some embodiments will be described below.

Some embodiments of a cleaning device 70 may include an ejection member, such as an ejection screw 75. In some embodiments, ejection members may have a diameter in a range from about 8 mm to about 16 mm. The ejection screw 75 may be positioned proximate the polishing roller 72 in the housing 71. The ejection screw 75 is a rotating member and may rotate about an axis substantially parallel to the axes of the image bearing member 31 and the polishing roller 72. In some embodiments, the ejection screw 75 extends from the interior of the housing 71 to a waste-toner collecting container provided outside the image forming unit 30. In some embodiments, toner removed from the surface of the image bearing member 31 and/or toner used for cleaning may be moved from the housing 71 to the waste-toner collecting container. For example, as shown in FIG. 2, ejection screw 75 serves to eject waste toner out of housing 71 into a waste-toner collecting container. As shown in FIG. 2, ejection screw 75 is provided on the right side of polishing roller 72 in housing 71. Ejection screw 75 is a rotating member that rotates about an axis substantially parallel to the axes of image bearing member 31 and polishing roller 72, and extends from the interior of housing 71 to a waste-toner collecting container (not shown) provided outside image forming unit 30. In some embodiments, an ejection member, such as the ejection screw 75 may rotate at a speed in a range from about 100 mm/s to about 250 mm/s. FIG. 2 depicts ejection screw 75 configured to eject waste toner in housing 71, which has been removed from the surface of image bearing member 31 and used for cleaning, to the outside of housing 71, that is, into the waste-toner collecting container.

After the toner image is primarily transferred from the surface of image bearing member 31 onto intermediate transfer belt 7, the above-described cleaning device 70 removes substances, such as toner, remaining on the image bearing member 31 with polishing roller 72 and cleaning blade 73, thereby cleaning the surface of the image bearing member 31.

Figure 3:
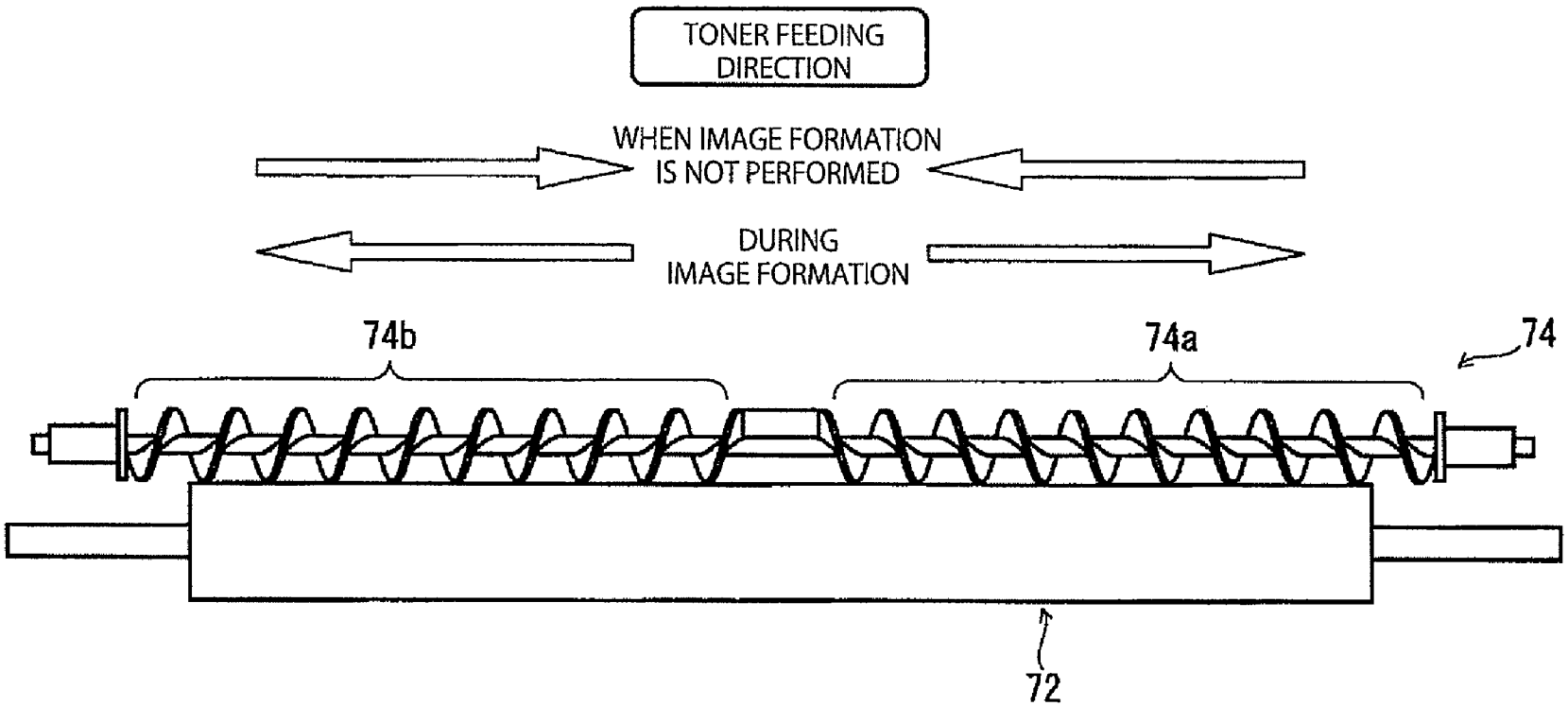
FIG. 3 is a right side view of a conveying screw and a polishing roller in the cleaning device of the embodiment shown in FIG. 2.

FIG. 3 depicts a right side view of conveying screw 74 and polishing roller 72 in cleaning device 70. Conveying screw 74 may serve as a rotating conveying member in cleaning device 70.

As shown in FIGS. 2-3, conveying screw 74 is provided above polishing roller 72. In some embodiments, the axis of conveying screw 74 extends parallel to the axis of polishing roller 72. Some embodiments may include the conveying member having almost the same length as that of the polishing roller 72. In some embodiments, conveying members may include one or more conveying portions positioned proximate the polishing roller 72. For example, as depicted in FIG. 3, conveying screw 74 includes two conveying portions 74*a*, 74*b* of a screw conveyor type. Conveying portions 74*a*, 74*b* may be provided on both sides of a point on the polishing roller 72. For example, as depicted in FIG. 3, conveying portions 74*a*, 74*b* may be provided proximate a midpoint of polishing roller 72 in the axial direction. In some embodiments, conveying portions 74*a*, 74*b* have screw blades that rotate in different directions.

During image formation, in some embodiments the polishing roller 72 may rotate such that at the contact portion between the polishing roller 72 and the image bearing member 31 both move in the same direction. For example, as depicted in FIG. 2, at a contact portion between polishing roller 72 and image bearing member 31 both move in the same direction. Given the configuration in FIG. 2, image bearing member 31 rotates counter-clockwise and polishing roller 72 rotates clockwise to meet these conditions. In the embodiment depicted in FIG. 2, conveying screw 74 rotates counter-clockwise. For the configuration depicted in FIG. 2, toner lying on the surface of polishing roller 72 near conveying screw 74 is thereby moved from almost the center of polishing roller 72 toward both ends in the axial direction (shown in FIG. 3).

In some embodiments, when image formation is not performed, the polishing roller 72 may rotate in a direction opposite the rotating direction during image formation. For example, the movement of the polishing roller 72 may be in the opposite direction relative to the image bearing member 31 when observed at the contact portion. In some embodiments, when the polishing roller 72 is rotating opposite the rotation of the image bearing member 31 at the contact portion, toner lying on the surface of the polishing roller 72 near the conveying member 74 may be moved from near both ends of the polishing roller 72 toward the center in the axial direction. For example, as shown in FIG. 3, toner lying on the surface of polishing roller 72 near conveying screw 74 is moved from near both ends of polishing roller 72 toward the center in the axial direction. When image formation is not performed, the image bearing member 31 may or may not rotate. In some embodiments, rotation of the image bearing member 31 may continue in a manner similar to that adopted during image formation. An embodiment may include an image bearing member 31 that is not rotating when images are not being formed.

As described above, an embodiment of cleaning device 70 may include polishing roller 72, ejection screw 75, and conveying screw 74. Polishing roller 72 removes and collects substances remaining on the surface of image bearing member 31 while in contact with the image bearing member 31. As shown in FIG. 2, ejection screw 75 serving as the ejection member may eject the substances collected by polishing roller 72 to the outside of cleaning device 70. Conveying screw 74 may serve as the rotating conveying member. In some embodiments, the rotating conveying member rotates to follow the rotation of polishing roller 72 while in contact with polishing roller 72. The rotating conveying member may convey the toner in cleaning device 70 along the surface of polishing roller 72 in the axial direction of polishing roller 72.

In some embodiments, the cleaning device 70 may be used to ensure uniform distribution of toner in the axial direction of the polishing roller 72. Various embodiments of cleaning device 70 may uniformly distribute (e.g., positively uniformized) the amount of toner adhering to the surface of polishing roller 72 in the axial direction while circulating the toner in cleaning device 70 with a simple structure without receiving any power from a motor or the like. This reliably prevents uneven polishing of the surface of the image bearing member 31. In an embodiment, cleaning devices 70 can ensure a high cleaning performance for the entire surface of the image bearing member 31.

Some embodiments of the cleaning device 70 may include a cleaning blade 73 capable of scraping off substances on the surface of the image bearing member 31. For example, FIG. 2 depicts cleaning blade 73 in contact with image bearing member 31. Cleaning blade 73 scrapes off substances remaining on the surface of the image bearing member 31. An embodiment of the cleaning blade 73 may inhibit friction noise and/or curling of cleaning blade 73. Friction noise and or curling of the cleaning blade 73 may occur due to a rapid increase in the coefficient of friction between the image bearing member 31 and the cleaning blade 73.

In some embodiments, the positioning of respective parts may be influenced by use of natural forces, such as gravity. For example, it may be possible to promote adhesion of toner onto the surface of the polishing roller 72 by utilizing the action of gravity and placing the conveying member 74 in a position above the polishing roller 72. As shown in FIG. 2, when conveying screw 74 is provided above polishing roller 72, it is possible to promote adhesion of toner onto the surface of polishing roller 72 by utilizing the action of gravity. Positioning of the respective parts in this manner may enhance the effect of uniformizing the amount of toner on the surface of polishing roller 72 in the axial direction. By uniformly distributing the toner, the uneven polishing of the surface of the image bearing member 31 may be inhibited. Thus, utilizing a cleaning device 70 as described above, may ensure a higher cleaning performance for the entire surface of the image bearing member 31.

In some embodiments, the rotating conveying member 74 may include conveying portions 74*a* and 74*b* each shaped like a screw conveyor. This configuration may allow the amount of toner on the surface of polishing roller 72 in the axial direction to be uniformly distributed (i.e., uniformized) utilizing a simple conveying member structure. Hence, uneven polishing of the surface of image bearing member 31 can be effectively prevented while avoiding increases in cost.

Further, since the conveying portions 74*a* and 74*h* of the conveying screw 74 respectively have a plurality of types of blades, toner can be concentrated at a desired position on the polishing roller 72. For example, conveying screw 74 may have conveying portions 74*a* and 74*b* that are provided on both sides of the center as a predetermined portion in the axial direction and that are helically oriented oppositely such that they rotate in different directions as conveying screw 74 rotates in a given direction. By concentrating toner at a position on the surface of the image bearing member 31, particularly a position where polishing is insufficient or filming easily occurs, the polishing effect can be improved. Hence, it is possible to ensure a higher cleaning performance for the entire surface of the image bearing member 31.

In some embodiments, when image formation is not performed, the polishing roller 72 rotates in the direction opposite the rotating direction during image formation. It is therefore possible to prevent toner from staying in a local area. This allows the amount of toner on the surface of the polishing roller 72 in the axial direction to be further uniformized. As a result, it is possible to further improve the cleaning performance of the cleaning device 70 for the entire surface of the image bearing member 31.

In some embodiments, a cleaning device 70 may be mounted in the image forming apparatus 1 to inhibit the uneven polishing of the surface of the image bearing member 31. As shown in FIG. 2, cleaning device 70 is mounted in image forming apparatus 1 to inhibit the uneven polishing of the surface of image bearing member 31. Thus, a high cleaning performance can be ensured for the entire surface of the image bearing member 31. This cleaning allows the image forming apparatus 1 to form images of high quality.

Figure 4:
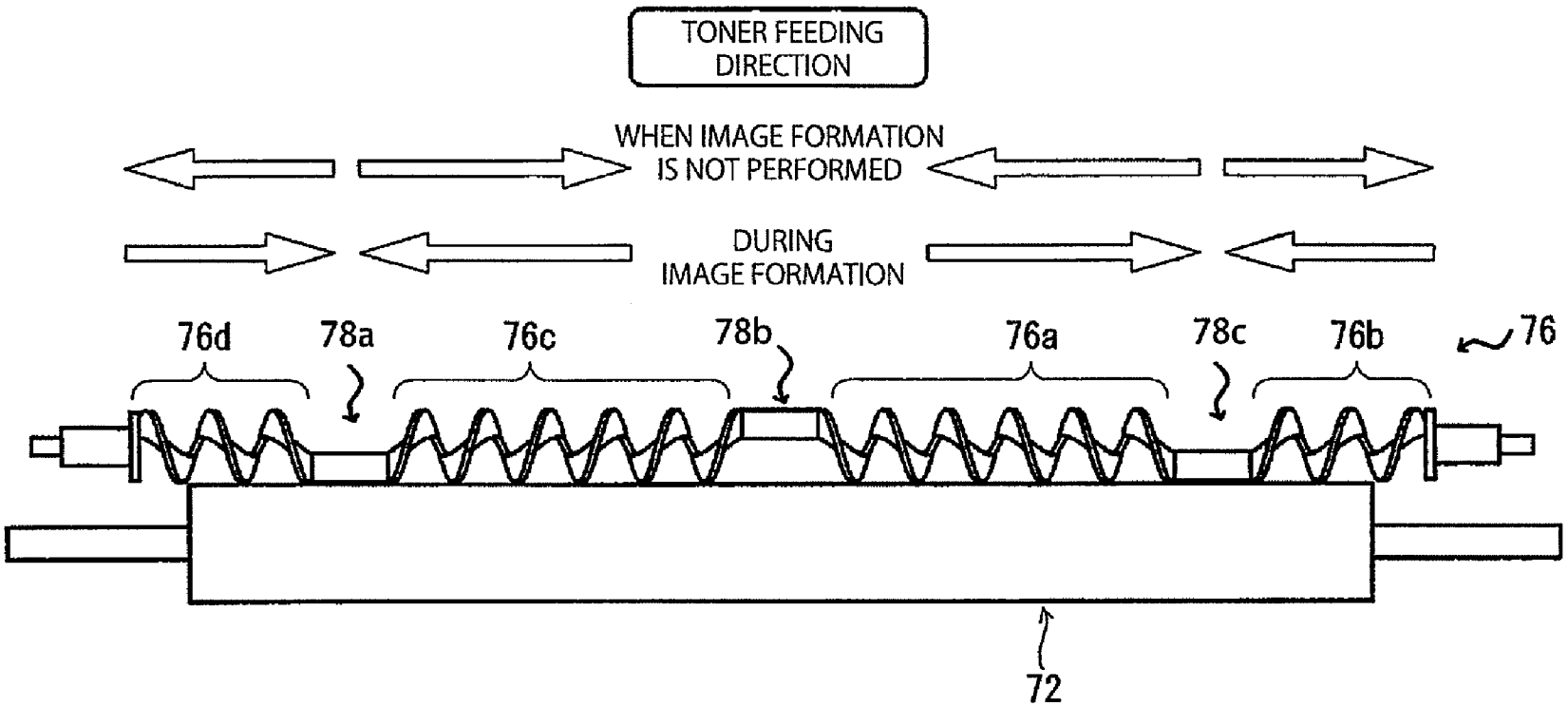
FIG. 4 is a right side view of a conveying spiral and a polishing roller in a cleaning device according to an embodiment of the present invention.

FIG. 4 depicts a right side view of a conveying spiral 76 and a polishing roller 72 in a cleaning device 70 in accordance with some embodiments. Cleaning device 70 includes conveying spiral 76 serving as a rotating conveying member. In some embodiments, the rotation of conveying spiral 76 follows the rotation of a polishing roller 72 by being in contact with polishing roller 72. The conveying spiral 76 conveys toner in the cleaning device 70 along a surface of polishing roller 72 in the axial direction. Conveying members, such as conveying spirals 76, may be divided into multiple portions. The size of the portions of the conveying members may differ. As shown in FIG. 4, conveying spiral 76 includes four conveying portions 76*a*, 76*b*, 76*c*, 76*d* of a spiral conveyor type. Conveying portions 76*a*, 76*b*, 76*c*, 76*d* vary in size. In some embodiments, there may be sections 78*a*, 78*b*, 78*c* positioned between the conveying portions 76*a*, 76*b*, 76*c*, 76*d*. In some embodiments, conveying portions 76*a*, 76*b*, 76*c*, 76*d* may have spirals that are configured to move materials in opposite directions as the spirals rotate in a common rotational direction. For example, as shown in FIG. 4, conveying portions 76*a*, 76*c* may have configurations that allow material in the spirals to move in different directions as conveying spiral 76 rotates in a given direction.

As shown in FIG. 4, during image formation, toner lying on the surface of polishing roller 72 proximate conveying spiral 76 moves from the approximate center and both ends of polishing roller 72 in the axial direction toward sections 78*a*, 78*b*, 78*c*. In contrast, when image formation is not performed, the rotating direction of polishing roller 72 is opposite the rotating direction during image formation. Thus, as shown in FIG. 4, toner lying on the surface of polishing roller 72 proximate conveying spiral 76 moves from sections 78*a*, 78*b*, 78*c* toward the center and both ends in the axial direction.

In this way, when the rotating conveying member 76 includes the conveying portions 76*a*, 76*b*, 76*c*, 76*d* each shaped like a spiral conveyor, the amount of toner on the surface of the polishing roller 72 can also be uniformized in the axial direction with a simple structure. The uniform distribution of toner may inhibit friction noise and curling of cleaning blade 73. In some embodiments, uniformly distributing toner may inhibit uneven polishing of the surface of image bearing member 31. Thus, uniform distribution of toner may reduce cost by lengthening the useful life of the image bearing member 31.

In some embodiments, a rotating direction of the spiral or screw may be changed multiple times along the length of the conveying member. For example, the rotating directions of the screws, spirals, or other geometries may vary along a length of the conveying member. Alternatively or additionally, a number of positions where the rotation of conveying portions of the conveying member (e.g., spirals or screw threads) change directions may vary in the various embodiments. In some embodiments, the conveying member may be divided into multiple conveying portions, as is illustrated in FIG. 4 with conveying portions 76*a*, 76*b*, 76*c*, 76*d*. Embodiments may include a conveying spiral 76 having a plurality of types of conveying spirals 76 and/or spiral portions having different spiral pitches (e.g., spirals per unit length). The spiral may be divided into portions, by sections at predetermined positions.

For example, in FIG. 4 conveying spiral 76 is divided into conveying portions 76*a*, 76*b*, 76*c*, 76*d* by sections 78*a*, 78*b*, 78*c*. In some embodiments, conveying spiral 76 includes a plurality of types of spirals that are configured to move material in different directions. In an embodiment, this allows toner to be concentrated at a desired position on polishing roller 72 in accordance with the sheet size. For example, by concentrating toner at a position on the surface of the image bearing member 31 in accordance with the sheet size, particularly at a position where polishing is insufficient or filming easily occurs, the polishing effect can be improved. Hence, it is possible to ensure a higher cleaning performance for the surface of the image bearing member 31.

In some embodiments, image forming apparatus 1 may include, but is not limited to an image forming apparatus 1 for color printing that transfers a toner image onto a sheet P with the intermediate transfer 7 belt in the above-described embodiments, an image forming apparatus 1 that does not use an intermediate transfer belt 7, an image forming apparatus 1 for monochrome printing, and other image forming apparatuses known in the art.

While the embodiments of the present invention have been described above, it is to be understood that various modifications can be made without departing from the scope of the invention.

Having thus described in detail embodiments of the present invention, it is to be understood that the invention defined by the foregoing paragraphs is not to be limited to particular details and/or embodiments set forth in the above description, as many apparent variations thereof are possible without departing from the spirit or scope of the present invention.

What is claimed is:

1. A cleaning device comprising:

a polishing roller configured to remove and collect a residual substance adhering to a surface of an image bearing member while rotating in contact with the image bearing member;

an ejection member configured to eject the substance collected by the polishing roller to the outside of the cleaning device; and a conveying member configured to convey toner in the cleaning device on a surface of the polishing roller in an axial direction of the polishing roller while rotating in contact with the polishing roller, wherein, when an image is not formed, the polishing roller rotates in a direction opposite a rotating direction in which the polishing roller rotates when an image is formed.

2. The cleaning device according to claim 1, further comprising:

a cleaning blade configured to scrape the residual substance off the surface of the image bearing member by being in contact with the image bearing member.

3. The cleaning device according to claim 1, wherein the conveying member is disposed above the polishing roller.

4. The cleaning device according to claim 1, wherein the conveying member includes a conveying portion shaped as a screw conveyor or a spiral conveyor.

5. The cleaning device according to claim 4, wherein the conveying portion includes a plurality of types of screw blades or spirals that are disposed along respective portions of the conveying portion in the axial direction of the polishing roller and wherein at least two of the plurality of types are configured to convey toner on the surface of the polishing roller in opposite directions along the axial direction as the conveying member rotates in a given direction.

6. The cleaning device according to claim 1, wherein the conveying member is configured to rotate to follow rotation of the polishing roller by being in contact with the polishing roller.

7. The cleaning device according to claim 1, wherein the conveying member is configured to convey toner in the cleaning device on the surface of the polishing roller such that the toner is uniformly distributed along the axial direction of the polishing roller.

8. An image forming apparatus comprising a cleaning device, wherein the cleaning device includes:

a polishing roller configured to remove and collect a residual substance adhering to a surface of an image bearing member while rotating in contact with the image bearing member;

an ejection member configured to eject the substance collected by the polishing roller to the outside of the cleaning device; and a conveying member configured to convey toner in the cleaning device on a surface of the polishing roller in an axial direction of the polishing roller while rotating in contact with the polishing roller, wherein, when an image is not formed, the polishing roller rotates in a direction opposite a rotating direction in which the polishing roller rotates when an image is formed.

9. The image forming apparatus according to claim 8, wherein the conveying member is configured to rotate to follow rotation of the polishing roller by being in contact with the polishing roller.

10. A cleaning device comprising:

means for removing and collecting a residual substance adhering to a surface of an image bearing member while rotating in contact with the image bearing member;

means for ejecting the substance collected by the removing and collecting means to the outside of the cleaning device; and means configured for conveying toner in the cleaning device on a surface of the removing and collecting means in an axial direction of the removing and collecting means while rotating in contact with the removing and collecting means, wherein, when an image is not formed, the removing and collecting means rotates in a direction opposite a rotating direction in which the removing and collecting means rotates when an image is formed.

* * * * *